US006054691A

United States Patent [19]

McGwire

[11] Patent Number: 6,054,691

[45] Date of Patent: Apr. 25, 2000

[54] BAND TYPE ELECTRIC HEATER

[75] Inventor: Tad McGwire, Branford, Conn.

[73] Assignee: IMS Company, Chagrin Falls, Ohio

[21] Appl. No.: 09/275,744

[22] Filed: Mar. 24, 1999

[51] Int. Cl.[7] ..... H05B 3/00

[52] U.S. Cl. ..... 219/535; 219/544; 219/546

[58] Field of Search ..... 219/535, 544, 219/546, 548, 534; 392/459, 480; 338/254, 277, 230

[56] References Cited

U.S. PATENT DOCUMENTS

| | | | |
|---|---|---|---|
| 1,150,426 | 8/1915 | Hadaway, Jr. . | |
| 1,384,467 | 7/1921 | Homan . | |
| 1,976,624 | 10/1934 | Mucher . | |
| 2,163,798 | 6/1939 | Mucher | 338/254 |
| 2,194,902 | 3/1940 | Heuer . | |
| 2,367,368 | 1/1945 | Osterheld | 392/459 |
| 2,460,625 | 2/1949 | Ellis . | |
| 2,545,653 | 3/1951 | Desloge . | |
| 2,801,321 | 7/1957 | Prindle | 392/459 |
| 2,817,742 | 12/1957 | Drugmand . | |
| 3,233,078 | 2/1966 | Siemainowski . | |
| 3,730,373 | 5/1973 | Kozbelt . | |
| 3,808,573 | 4/1974 | Cappell . | |
| 3,829,654 | 8/1974 | Eisler . | |
| 3,829,657 | 8/1974 | Hinz . | |
| 3,872,281 | 3/1975 | Krieg et al. . | |
| 3,912,907 | 10/1975 | Lodi . | |
| 4,203,197 | 5/1980 | Crandell | 219/535 |
| 4,292,503 | 9/1981 | Brent | 219/535 |
| 4,311,900 | 1/1982 | Hummel | 219/535 |
| 5,359,179 | 10/1994 | Desologe et al. . | |
| 5,667,712 | 9/1997 | Sutorious et al. . | |

*Primary Examiner*—John A. Jeffery

*Attorney, Agent, or Firm*—Watts Hoffmann; Fisher & Heinke

[57] ABSTRACT

A band type heater for mounting on a tubular member and transferring heat to the tubular member comprising an elongated electric resistance heater, a layer of insulating material, and a single piece heat conducting shell. The elongated heater is surrounded by the layer of insulating material and extends along a generally cylindrical curved path. The heat conducting shell is disposed about the elongated heater and insulating material. The heat conducting shell is formed by a thin metal sheet having first and second shell edges wrapped about the heater and insulating material and forming an inner heater face and an outer heater face. The first and second shell edges extend closely adjacent one another along one of the faces.

9 Claims, 2 Drawing Sheets

BAND TYPE ELECTRIC HEATER

FIELD OF THE INVENTION

The invention relates to electric band heaters and more particularly to electric band heaters having improved sealing characteristics and a reduced number of parts.

BACKGROUND ART

Electric band type heaters are used to transfer heat to pipes and other cylindrical vessels. Band heaters are so called because they have a cylindrical shape, similar to a segment of a pipe, and are secured around the pipe to be heated with an inner face in heat transfer contact with the outer surface of the pipe. Band heaters are commonly used in the plastic molding industry to heat barrels and nozzles carrying molten plastic for injection molding or extrusion. The heat from the band heaters maintains the molten plastic temperature, and hence its fluid state and other essential characteristics, while it is being transported to the mold or extruder. When they are used in the plastic molding industry, band heaters may be exposed to molten plastic that leaks from the machinery as well as other potentially detrimental fluids in the factory environment. Therefore, it is advantageous to provide a band heater that resists infiltration by fluids.

Generally, band heaters are made up of an elongated electric heating element, an electrical insulator, and a multipart outer shell assembly that contains the heating element and insulation and provides for heat transfer from the band heater. Prior art band heaters have heat conducting shells made of two pieces, a pressure band and a base member. U.S. Pat. No. 3,872,281 describes such a prior art electric band heater. The pressure band is an elongated planar strip of conductive material such as steel that is narrower than the heating element/insulating material combination. The base member is a U shaped channel that receives the heating element and insulating material. The pressure band is placed on top of the insulative material such that it fits within the base member. The short, upstanding base member sides are then crimped down over the edges of the pressure band to retain the pressure band. This forms two pressure band to base member seams. The assemblage is then formed into a band configuration so that it can conform to a pipe when installed. Because a smooth, substantially continuous heat transfer surface is desirable, the pressure band and the pressure band to base member overlapped seams are often disposed around the radially outer face of the band heater. When installed, the band heater is placed on a pipe and a hose clamp is tightened about it. The crimped U channel sides are stiffer than the pressure band. When the hose clamp engages the pressure band between the crimped U channel sides the pressure band to base member seams tend to open. The open seams expose the heater band interior to environmental fluids. The seams are vulnerable to the ingress of molten plastic, airborne vapors or other destructive chemicals that may damage the heating element or insulation, unless each pressure band to base member seam is covered with a clamp.

If the band heater is constructed so that the pressure band to base member seams are disposed on the inner face of the band heater, the heat transfer surface is uneven and heat transfer will not be optimum because the heat transfer contact between the heater band and pipe is limited to the small areas of the crimped base member sides.

The present invention provides a new and improved electric band heater having a single piece outer heat conducting shell that provides a smooth substantially continuous heat transfer surface and is relatively resistant to the ingress of liquids.

SUMMARY OF THE INVENTION

An electric band type heater of the present invention has an elongated electric resistance heating element, a layer of electrically insulating material, and an outer heat conducting shell enclosing the heater and insulating material. The elongated heating element extends along a generally cylindrically curved path with opposite ends disposed adjacent to each other. The elongated heating element is surrounded by and is in heat transfer relationship with the electrically insulating material. The heat conducting shell is a thin metal sheet having first and second shell edges and is formed to substantially enclose the elongated electric heating element and insulating material. The heat conducting shell is in heat transfer relationship with the insulating material and forms a generally cylindrical inner heater face and a generally cylindrical outer heater face. The heat conducting shell has opposite side sections that maintain the faces in firm heat transfer engagement with the insulating layers and first and second shell edges disposed adjacent to one another.

In one embodiment of the present invention the heat conducting shell is formed such that the first and second shell edges are disposed on the inner heater face and closely adjacent one another thereby providing a relatively smooth, substantially continuous heat transfer surface. When the band heater is secured about a tubular member to be heated, the closely adjacent shell edges are maintained in firm contact with the tubular member, reducing the possibility that fluid may flow into the area between the shell edges.

In another embodiment of the present invention the heat conducting shell is formed such that the first and second shell edges overlap one another, covering the entire outer heater face. The inner heater face is seamless, providing a smooth continuous heat transfer surface. When the band heater is secured about a tubular member to be heated, the overlapping shell edges are covered by a clamp or other securing device to maintain firm contact between the heat transfer surface and the tubular member. Use of the clamp which covers the seam formed by the overlapping shell edges reduces the possibility that liquid will flow into the seam.

These and other objects, advantages and features of the present invention will be understood by a review of the invention which is described in conjunction with the accompanying drawings.

BEST MODE FOR PRACTICING THE INVENTION

Figure 1:
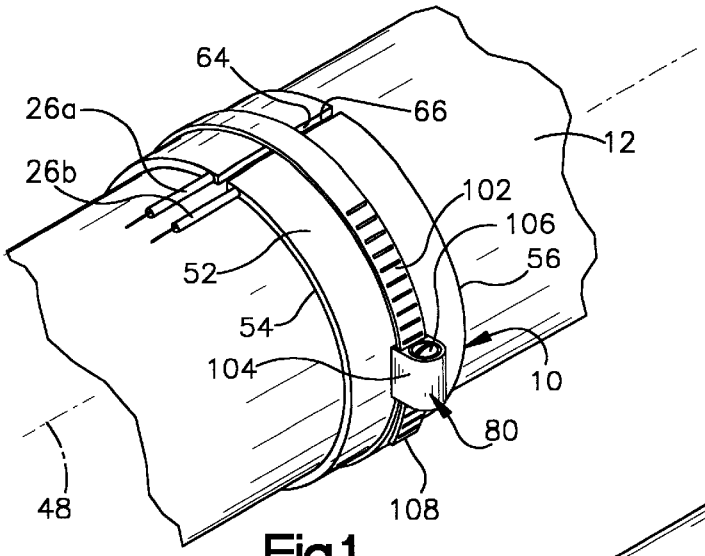
FIG. 1 is a perspective view of a band type electric heater constructed according to the present invention installed on a tubular member.
Figure 2:
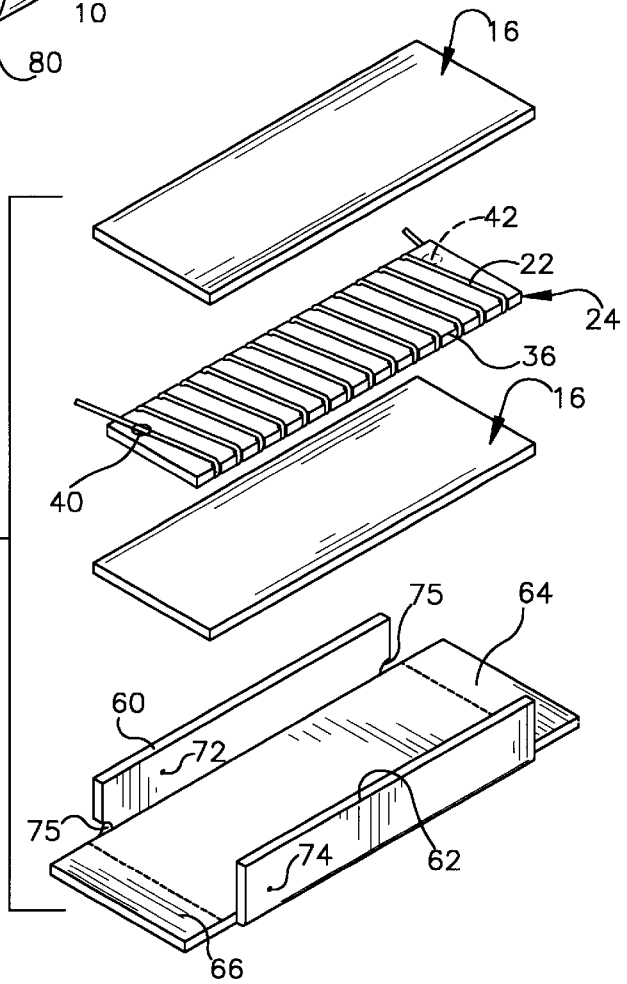
FIG. 2 is an exploded view of a partially constructed band type heater embodying the present invention.

FIGS. 1–4 illustrate a band type heater 10 constructed according to the present invention mounted on a tubular member 12 for transferring heat to the tubular member. The band heater 10 comprises an elongated, curved heater assembly 14, a curved layer of insulating material—indicated by the reference character 16—disposed on each side of the heater assembly in heat transfer relationship with the assembly and, a heat conducting shell 18 disposed about the heater assembly 14 and insulating material 16. See FIG. 3. The heater 10 is secured to the tubular member 12 with the opposite band heater ends 10*a*, 10*b* closely adjacent each other and the band heater 10 tightly hugging the member 12 for maximizing heat transfer to the member 12 (FIG. 1).

The member 12 is not illustrated in detail because it may be a pipe, hose, nozzle, barrel or any other vessel requiring heating. A common application of the band heater 10 is for heating barrels, nozzles and manifolds through which molten plastic flows in molding processes. Whether used in the plastic molding industry or some other manufacturing facility, band heaters must be protected from the ingress of environmental fluent materials that can short circuit the band heater. The band heater 10 is so constructed and arranged that it resists infiltration by potentially damaging fluent materials.

The heater assembly 14 is illustrated as an electric resistance heater that extends within an arcuate channel 20 in the insulating material 16. In the preferred embodiment the heater assembly comprises a resistance heater element 22, an element support 24, and power leads 26*a*, 26*b* for connecting the element 22 to an electric power supply. The preferred element 22 is formed by a nichrome ribbon, or wire, distributed along the support 24 in a serpentine configuration to distribute the heat generated by the band heater.

The element support 24 is formed by an electrical insulating, heat-resistant material that firmly supports the heater element 22 yet is capable of flexing to an arcuate shape that conforms to the channel 20. The illustrated support is in the form of a thin, generally rectangular sheet. The element 22 is shown helically wound onto the support 24 with the element turns anchored by notches 32 formed in opposite support side edges 34, 36. The notches anchor the heater element coils against shifting along the support so they do not make contact with each other. The heater element opposite ends 40, 42 are disposed in the vicinity of the band heater opposite ends 10*a*, 10*b*, respectively. In the preferred heater band each heater element end 40, 42 is anchored to the support 24 and bonded, crimped, or otherwise electrically connected to a respective power lead 26. Apertures are formed in opposite support ends to assist in anchoring the heater element ends relative to the support. Eyelets or rivets (not shown) may be staked into the apertures for connection to the heater element ends, if desired. The lead 26*a* extends from the band heater end 10*a* while the other lead 26*b* extends from the band heater end 10*b*. The leads 26 are covered by electrical insulating shrink tubes and extend to a suitable source of electrical power. In the preferred band heater, the support is formed by a thin mica sheet (approximately 0.015 inch thick) that is flexible to an arcuate shape as the band heater flexes to conform with the external shape of the member 12.

The insulating material 16 in the illustrated and preferred embodiment is formed from thin wall layers of electrical insulating material between the heater element 22 and the shell 18. The electrical insulating layers, because they are quite thin, enable effective heat transfer from the heater assembly to the shell. The layers are also quite flexible to facilitate band heater flexing to conform to the member 12. The preferred insulating material is in the form of separate mica sheets that sandwich the heater assembly between them, although other forms of insulation can be employed, e.g. molded or wrapped insulation layers. The mica sheets forming the material 16 are 0.015 thick, or less, and the same length as, and slightly wider than, the support 24 so that the heater element 22 can not contact the shell 18.

The heat conducting shell 18 is disposed about the heating element 22 and the insulating material 24 for efficiently transferring heat from the element to the member 12. The shell 18 comprises a thin metal sheet that is formed so that it wraps about the element and insulation material and defines an arcuate or generally cylindrical shaped band heater disposed about a longitudinal axis 48. The shell 18 defines an arcuate inner heater face 50, an arcuate outer heater face 52, opposite side sections 54, 56 extending between and continuous with the inner and outer faces, first and second shell edges 60, 62 extending closely adjacent each other along one of the faces, and opposite shell end constructions 64, 66 that close the heater ends 10*a*, 10*b* about the element and insulation.

Figure 4:
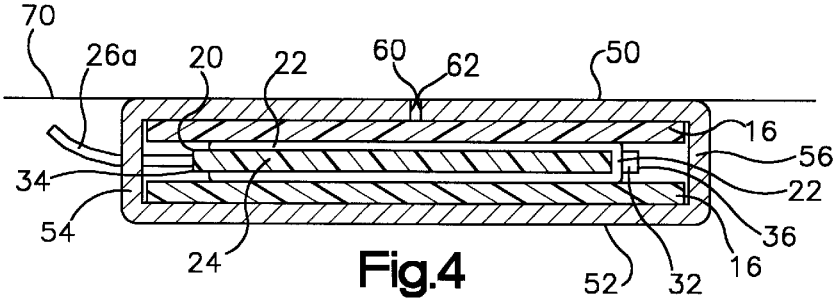
FIG. 4 is a cross sectional view seen approximately from the plane indicated by the line 4—4 of FIG. 3.
Figure 3:
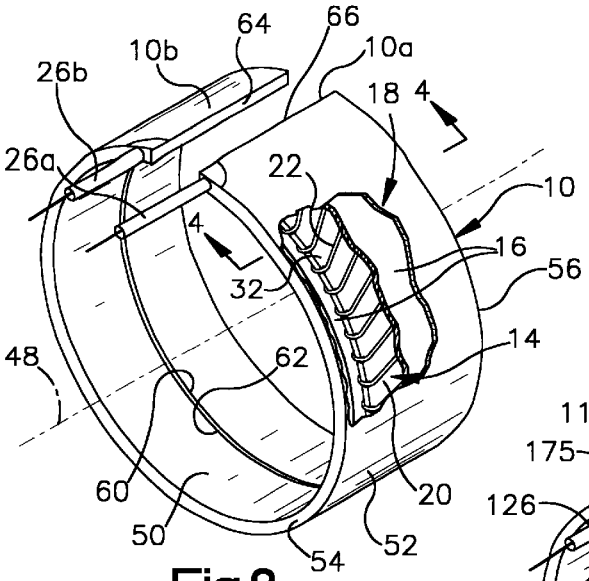
FIG. 3 is a perspective view of the band heater of FIG. 1.

The shell inner face 50 is constructed and arranged to engage the member 12 over a large area surface so that conductive heat transfer to the member 12 via the band heater-member 12 interface may be maximized. FIGS. 1, 3 and 4, illustrate one preferred shell construction. The illustrated shell inner face 50 is substantially continuous and regular. More particularly, the preferred inner face 50 lies along a substantially straight line generatrix 70 (FIG. 4) extending parallel to the axis 48 that is moved through space along an arcuate path spaced from the axis 48. The face 50 thus generated is capable of intimate full surface contact with the member 12.

The band heater embodiment illustrated by FIGS. 1, 3 and 4 is constructed by bending a planar sheet of the shell material along parallel lines that correspond to the side sections 54, 56 so that the sheet has a generally "U" shaped cross section (see FIG. 2) with the edges 60, 62 disposed at the ends of the "U" legs 72, 74. The heater assembly and insulating material are placed on the shell 18 between the "U" legs 72, 74. The end constructions 64, 66 are formed by tongues extending from opposite sheet ends that are folded over the element and insulation material and crimped in place. The leads 26 extend from the respective heater ends 10*a*, 10*b* through notches 75 formed in the "U" legs 72. The "U" legs 72, 74 are folded toward each other and crimped into place against the insulating material to firmly grip the heater assembly and insulating material within the shell. The side sections 54, 56 are continuous with inner and outer shell faces and are deformed and crimped so that they force the legs 72, 74 into firm engagement with the insulation material for efficient heat transfer. The leg edges 60, 62 extend closely adjacent each other.

The band heater construction is completed by forming the heater into a tightly curved, generally annular shape with its ends 10*a*, 10*b* adjacent each other. The forming step can be accomplished by passing the heater through a succession of rolls that deform the shell and create the final shape, or by bending the heater about a mandrel or other suitable forming device. As the band heater is being formed, the element and insulating materials are resiliently deformed into generally arcuate shapes that conform to the band heater shape. In the band heater illustrated by FIGS. 1–4, the U legs are dimensioned so that the leg edges 60, 62 are closely adjacent to each other in substantial abutting relationship but not overlapping. The band heater is formed with the edges 60, 62 extending along the inner face 50.

The completed band heater is installed on the member 12 by resiliently spreading the heater ends 10*a*, 10*b* so that the member 12 passes between them and then securing the band heater in place so it tightly engages the member. The band heater 10 is secured in place about the member 12 so that the inner heater face 50 is urged into tight, substantially full face, heat transfer contact with the tubular member. At the same time, due to the tight engagement between the band heater face 50 and the member 12, the band heater interior is substantially sealed against environmental fluent material that might otherwise enter the heater via the narrow gap between the edges 60, 62. In the preferred and illustrated embodiment of the invention the band heater is clamped about the member 12. As illustrated in FIG. 1, a screw-type hose clamp 80 surrounds the band heater and is tightened so that the band heater ends 10*a*, 10*b* are drawn towards each other as the inner face 50 is forced into tight engagement with the member 12. The illustrated hose clamp is conventional and comprises a slotted metal ribbon 102, a screw housing 104 fixed to one ribbon end, and a screw 106 rotatably mounted in the housing. The screw is externally threaded and its thread engages slots in the ribbon 102 when the ribbon is formed into a band and its free end 108 is pushed through the housing where the screw threads can be engaged. After the band heater has been fitted onto the member 12, the hose clamp ribbon is placed around the heater and the ribbon end 108 is fed into the housing 104 so the screw thread is engaged in a ribbon slot. The screw is then turned to engage the thread in successive ribbon slots and cinch the ribbon 102 tightly about the band heater 10. As the heater 10 tightens, the ends 10*a*, 10*b* are pulled towards each other and into engagement with the member 12.

Although a hose clamp 80 is illustrated for securing the band heater in place about the member 12, other forms of clamps, wraps, flanges with screws or other securing mechanisms may be used. Any such mechanism is acceptable so long as it maintains the surface 50 in tight, full face contact with the member 12 so that conductive heat transfer to the member 12 is maximized.

Figure 5:
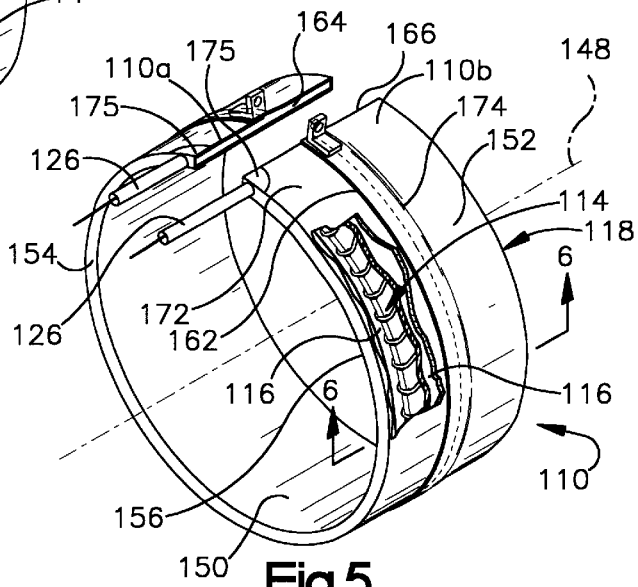
FIG. 5 is a perspective view of a band heater constructed according to an alternative embodiment of the invention.
Figure 6:
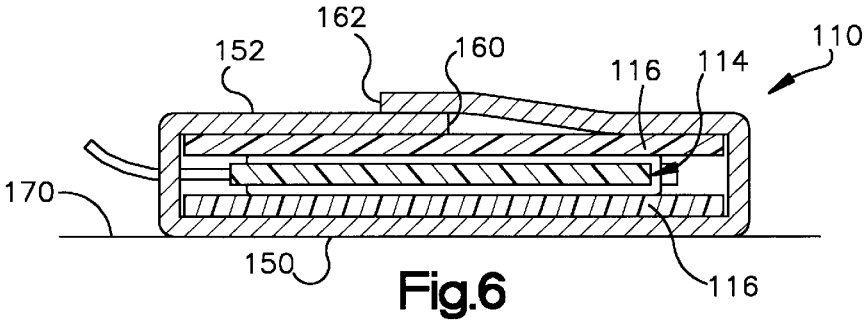
FIG. 6 is a cross sectional view seen approximately from the plane indicated by the line 6—6 of FIG. 5.

An alternative band heater construction 110 is illustrated by FIGS. 5 and 6. The band heater 110 comprises an elongated, curved heater assembly 114, a curved layer of insulating material—indicated by the reference character 116—disposed on each side of the heater assembly in heat transfer relationship with the assembly and a heat conducting shell 118 disposed about the heater assembly 114 and insulating material 116. The heater 110 is secured to a tubular member 12 with the opposite band heater ends 110*a*, 110*b* closely adjacent each other and the band heater 110 tightly hugging the member 12 for maximizing heat transfer to the member 12. The heater assembly 114 and insulation materials 116 are identical to the heater assembly 14 and insulation materials 16 of FIGS. 1–4 and therefore will not be described further.

The shell 118 is disposed about the heater assembly 114 and insulating material 116 for efficiently transferring heat to the member 12. The shell 118 comprises a thin metal sheet that is formed so that it wraps about the heater assembly 114 and insulating material 116 and defines an arcuate or generally cylindrical shaped band heater disposed about a longitudinal axis 148. The shell 118 defines an arcuate inner heater face 150, an arcuate outer heater face 152, opposite side sections 154, 156 extending between and continuous with the inner and outer faces, first and second shell edges 160, 162 extending closely adjacent each other along one of the faces, and opposite shell end constructions 164, 166 that close the heater ends 110*a*, 110*b* about the heater assembly 114 and insulating material 116.

The shell inner face 150 is constructed and arranged to engage the member 12 over a large area surface so that conductive heat transfer to the member 12 via the band heater-member 12 interface may be maximized. The shell inner face 150 that is illustrated in FIGS. 5 and 6 is substantially continuous and regular. As noted previously in connection with FIGS. 1–4, the preferred inner face 150 lies along a substantially straight line generatrix 170 extending parallel to the central band heater axis 148 that is moved through space along an arcuate path spaced from the axis 148. The face 150 thus generated is capable of intimate full surface contact with the member 12.

The band heater embodiment illustrated by FIGS. 5 and 6 is constructed by bending a planar sheet of the shell material along parallel lines that correspond to the side sections 154, 156 so that the sheet has a generally "U" shaped cross section with the edges 160, 162 disposed at the ends of the "U" legs 172, 174. The heater assembly and insulating material are placed on the shell 118 between the "U" legs 172, 174. The end constructions 164, 166 are formed by tongues extending from opposite sheet ends that are folded over the element and insulation material and crimped in place. The leads 126 extend from the respective heater ends 110*a*, 110*b* and are positioned to be fed through notches 175 formed in the U leg 172. The U legs 172, 174 are folded toward each other and crimped into place against the insulating material to firmly grip the heater assembly and insulating material within the shell. The side sections 154, 156 are continuous with inner and outer shell faces and are deformed and crimped so that they resiliently force the legs 172, 174 into firm engagement with the insulation material for efficient heat transfer. The leg edges 160, 162 extend closely adjacent each other.

The band heater construction is completed by forming the heater into a tightly curved, generally annular shape with its ends 110*a*, 110*b* adjacent each other. As noted, the forming step can be accomplished by passing the heater through a succession of rolls that deform the shell and create the final shape, or by bending the heater about a mandrel or other suitable form. The heater assembly 114 and insulating material 116 are resiliently bent into generally annular shapes that conform to the band heater shape. In the band heater illustrated by FIGS. 5 and 6, the U legs are dimensioned so that when the band heater is constructed, the leg edges 160, 162 are closely adjacent each other and slightly overlapped. The band heater is formed with the edges 160, 162 extending along the outer face 152.

The completed band heater 110 is installed on the member 12 by resiliently spreading the heater ends 110*a*, 110*b* so that the member 12 passes between them and then securing the band heater in place so it tightly engages the member with the inner heater face 150 in tight, substantially full face, heat transfer contact with the tubular member. In the preferred and illustrated embodiment of the invention the band heater is clamped about the member 12.

Figure 7:
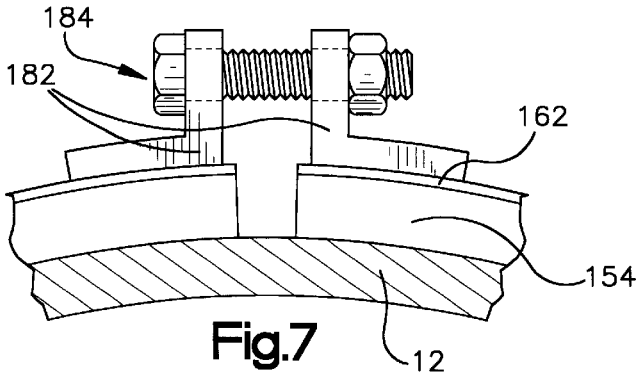
FIG. 7 is an enlarged fragmentary view of the band heater of FIGS. 5 and 6 installed on a tubular member.

An example of a clamping arrangement 188 is illustrated by FIGS. 5 and 7 as comprised of "L" shaped brackets 182 that are welded to the U-leg 174 adjacent to the edge 162 at the respective opposite heater ends 110*a*, 110*b*. A nut and bolt fastener 184 is associated with holes in the brackets 182 so that when the fastener is tightened the band heater ends are drawn toward each other to tighten the heater about the member 12. The clamp tightening has the effect of clamping the U-leg 174 evens more tightly against the U-leg 172 to enhance the scaling relationship between the overlapped edges 160, 162.

Although a clamp formed by brackets and or nut and bolt fastener is illustrated, a hose clamp like that illustrated and described above, or any other suitable securing mechanism can be employed to secure the band heater 110 in place.

If a hose clamp is installed, it preferably overlies the edges 160, 162. When the clamp is tightened, the overlapped edges are clamped together resulting in a tightly sealed lapped joint extending about the band heater.

While two preferred embodiments of the invention have been illustrated and described in detail, the invention is not to be considered limited to the precise constructions disclosed. Various adaptations, modifications and uses of the invention may occur to those skilled in the art to which the invention relates. The intention is to cover all such adaptations, variations, modifications, and uses that fall within the scope or spirit of the claims.

Having described my invention I claim:

1. A band type electric heater having a generally cylindrical shape and further having an inner face and an outer face, said heater comprising:

a) an electric heating element;

b) first and second sheets of electrically insulating material respectively disposed on opposite sides of said electric heating element;

c) a single piece elongated heat conducting shell having a generally annular shape comprising two lengthwise edge portions disposed on an inner face of said shell with said opposite ends of said shell disposed adjacent each other, said heat conducting shell substantially enclosing said sheets of said electrically insulating material and said electric heating element; and, d) a clamp for securing said heater around a tubular member with said inner face tightly in heat transfer relationship with said member, said clamp comprising a band or ring aligned with said edge portions for clamping said edge portions and tightly secured around said outer face.

2. The band type electric heater of claim 1 wherein said heat conducting shell is made of steel or similar material having high heat conductivity.

3. The band type electric heater of claim 1 wherein said insulating material is mica.

4. The band type electric heater of claim 1 wherein said electric heating element comprises conductive windings of nichrome.

5. A band type electric heater for heating a generally tubular member, said heater arcuately curved about a central axis and having an inner face and an outer face, said heater comprising:

a) an electric heating element;

b) a layer of electrically insulating material disposed on the radially inner and outer sides of said electric heating element;

c) a single piece elongated heat conducting shell having a generally arcuate shape comprising two lengthwise edge portions, said heat conducting shell enclosing substantially all of said layers of said electrically insulating material and said element, said lengthwise edge portions overlapping one another and disposed on said outer face; and d) a clamp for maintaining said band type electric heater in heat transfer relationship with said generally tubular member.

6. A band type heater constructed for mounting on a tubular member and transferring heat to the tubular member, the heater comprising:

a) an elongated electric resistance heating element extending along an arcuate path with opposite ends disposed adjacent each other;

b) a generally arcuately curved layer of electrical insulating mica disposed on each side of said heating element and in heat transfer relationship with said element each layer of mica having a thickness of less than about 0.015 inch;

c) a heat conducting shell disposed about said element and said layers, said shell comprising a thin metal sheet wrapped about said element and said layers, said shell defining a generally cylindrical inner heater face, a generally cylindrical outer heater face, opposite side sections continuous with said inner and outer faces that resiliently maintain said faces in firm heat transfer engagement with said insulating mica, first and second shell edges extending closely adjacent each other along said inner heater face, and opposite shell ends disposed adjacent each other; and, d) a clamp tightly secured around said outer heater face for securing said heater around the tubular member with said inner face tightly in heat transfer relationship with said member, said clamp comprising a band or ring aligned with said edge portions for clamping said edge portions;

e) said heater disposed about the tubular member with said inner heater face urged into substantially full face heat transfer contact with the tubular member to seal the band heater interior against environmental fluent material that might otherwise enter the heater between the first and second adjacent shell edges.

7. A band type electric heater having a generally cylindrical shape and further having an inner face and an outer face, said heater comprising:

a) an electric heating element;

b) a layer of electrically insulating material disposed on either side of said electric heating element; and c) a single piece elongated heat conducting shell having a generally annular shape comprising two lengthwise edge portions that overlap one another, said heat conducting shell substantially enclosing said layers of said electrically insulating material and said electric heating element.

8. A band type electric heater having a generally cylindrical shape and further having an inner face and an outer face, said heater comprising:

a) an electric heating element;

b) a layer of electrically insulating material disposed on either side of said electric heating element;

c) a single piece elongated heat conducting shell having a generally annular shape comprising two lengthwise edge portions disposed on said outer face, said heat conducting shell substantially enclosing said layers of said electrically insulating material and said electric heating element; and, d) a clamp for securing said heater around a tubular member with said inner face tightly in heat transfer relationship with said member, said clamp comprising a band or ring tightly secured around said outer face and aligned with said edge portions for clamping said edge portions together.

9. A band type heater constructed for mounting on a tubular member and transferring heat to the tubular member, the heater comprising:

a) an elongated electric resistance heating element extending along an arcuate path with opposite ends disposed adjacent each other;

b) a generally arcuately curved layer of electrical insulating material disposed on each side of said heating element and in heat transfer relationship with said element; and, c) a heat conducting shell disposed about said element and said layers, said shell comprising a thin metal sheet wrapped about said element and said layers, said shell defining a generally cylindrical inner heater face, a generally cylindrical outer heater face, opposite side sections continuous with said inner and outer faces that resiliently maintain said faces in firm heat transfer engagement with said insulating material, first and second shell edges extending closely adjacent each other along one of said faces, and opposite shell ends disposed adjacent each other;

d) said heater disposed about a tubular member with said inner heater face urged into substantially full face heat transfer contact with the tubular member and said first and second shell edges overlapping each other and extending along said outer heater face.

* * * * *